US006457981B1

(12) United States Patent
Yamanashi et al.

(10) Patent No.: US 6,457,981 B1
(45) Date of Patent: Oct. 1, 2002

(54) WIRING UNIT AND ELECTRIC JUNCTION BOX

(75) Inventors: Makoto Yamanashi; Takao Murakami; Hiroyuki Suzuki, all of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/835,628

(22) Filed: Apr. 17, 2001

(30) Foreign Application Priority Data

Apr. 18, 2000 (JP) ..... 2000-116463

(51) Int. Cl.[7] ..... H01R 12/00
(52) U.S. Cl. ..... 439/76.2; 439/46
(58) Field of Search ..... 439/76.2, 75, 78, 439/45–49, 510–515

(56) References Cited

U.S. PATENT DOCUMENTS 5,040,996 A * 8/1991 Kobold et al. ..... 439/76
5,057,026 A * 10/1991 Sawai et al. ..... 439/76

* cited by examiner

*Primary Examiner*—Khiem Nguyen
(74) *Attorney, Agent, or Firm*—Armstrong, Westerman & Hattori, LLP

(57) ABSTRACT

A wiring unit is provided, which includes: insulative substrates, each having through holes, to be stacked up each other; strip conductors, each having contact holes meeting the respective through holes, to be arranged in parallel on each of the insulative substrate; and a conductor pin consisting of a pin portion of conductive material to be inserted into both the through hole and the contact hole with a gap therewith and a conductor contact portion radially projecting from the pin portion so as to be put into contact with the strip conductor. The conductor contact portion has a peripheral portion to be put into contact with the strip conductor. At least one of the strip conductors has a male tab to protrude from the insulative substrate so as to be connected with a terminal electrically connected with external equipment. And, an electric junction box further includes a connector unit consisting of a wire, a terminal connected with the wire, and a housing accommodating the terminal is provided.

5 Claims, 6 Drawing Sheets

WIRING UNIT AND ELECTRIC JUNCTION BOX

BACKGROUND OF THE INVENTION

1. Field of the Invention

The present invention relates to a wiring unit and an electric junction box installed in a motor vehicle.

2. Description of the Related Art

Generally, a motor vehicle is equipped with various electronic equipment, namely, lamps such as a head lamp and a tail lamp, and motors such as a starter motor and a motor for an air conditioner.

A junction block is arranged at appropriate points of a motor vehicle in order to supply electric power to the electronic equipment. The junction block is formed by stacking up wiring substrates each having a printed substrate or a busbar and by arranging various and a large number of electric circuit units such as electric relays and fuses.

Here, the junction block may be called fuse block, relay box or electric junction box. In the present specification, a fuse block, a relay box, or a junction block is called an electric junction box hereinafter.

The electric junction box has a casing, a wiring unit 54 (FIG. 7) accommodated in the casing, a waterproof casing, and so on. The casing has a front casing and a back casing. The back casing has a flat bottom wall and a peripheral wall extending from the periphery of the bottom wall. Wires connected with the above electronic equipment are led into the back casing.

The front casing is formed tabularly and arranged opposite the above back casing, while having a gap against the bottom wall of the back casing. Mounting portions for mounting relays, fuses, connectors, and so on are provided on the front casing. The waterproof casing is attachable to and detachable from the rim portion of the peripheral wall of the back casing and, when attached, covers the front casing with the aid of the back casing.

The wiring unit 54 of FIG. 7 is arranged between the front casing and the back casing and is accommodated in the back casing. The wiring unit 54 electrically connects the wires led into the back casing to the relay, fuse, connector, and so on arranged on the front casing according to a given pattern.

The above wiring unit 54 has stacked substrates 61, terminals 62 and connection pins 63. The substrate 61 is made of insulative material and is formed in a generally rectangular plate.

The substrate 61 has a plurality of grooves 64, recesses 65 and through holes 66. The grooves 64 extend in parallel in a longitudinal direction of the substrate 61. The recesses 65 open in one groove 64 and are lined up in a longitudinal direction of the groove 64.

The through holes 66 are bored through respective bottoms of the recesses 65. The substrates 61 have the same arrangement of the through holes 66.

The terminal 62 is made of conductive metal plate and has a pin fitting portion 67 and a wire pressure welding portion 68 as shown in FIG. 8. The pin fitting portion 67 can receive the above connection pin 63.

The wire pressure welding portion 68 defined a direction of the wire 69 (FIG. 7). The wire pressure welding portion 68 has a pair of pressure welding portions 70 to pressure-welded the wire 69 and a pair of wire holding portions 71.

The pressure welding portion 70 has pressure welding pieces 72 which cut the sheathing portion of the wire 69 and get in contact with the core wire. The wire holding portion 71 has a pair of nipping pieces 73 to nip the above wire 69. The nipping pieces 73 put the wire 69 therebetween.

The pin fitting portion 67 is arranged relatively to the wire pressure welding portion 68 in order not to hinder the wire 69 from being arranged as shown in FIG. 8.

The terminal 62 electrically connects the connection pin 63 inserted into the pin fitting portion 67 to the wire 69 pressure-welded to the wire pressure welding portion 68. And, the terminal 62 is attached to the above substrate 61 in a state that the above pin fitting portion 67 is accommodated in the recess 65 and the wire pressure welding portion 68 is accommodated in the groove 64.

The connection pin 63 is made of conductive material in a strip-like shape. The connection pin 63 is electrically connected to the above wire 69 when inserted into the pin fitting portion 67 of the terminal 62 through the above through hole 66.

The wires 69 connected to various electronic equipment are arranged in the grooves 64 of the wiring unit 54, while arbitrarily selecting the recesses 65 and the through holes 66 according to a given pattern, and are electrically connected to the relay, fuse, connector, and so on which are mounted on the mounting portions of the above front casing.

With respect to the above prior art wiring unit 54, however, since the grooves 64 and the recesses 65 are formed on the substrate 61, the shape of the substrate 61 becomes relatively complicated, thereby making the molding pattern complicated and therefore increasing the cost. And, since the terminal 62 is formed by bend a metal plate at a lot of points, the work needs much man-hour, thereby increasing the cost. Further, since the recesses 65 are formed beside the groove 64, the width of the substrate 61 become large, thereby large-sizing the wiring unit 54.

SUMMARY OF THE INVENTION

In view of the foregoing, an object of the present invention is to provided a wiring unit and an electric junction box enabling downsizing and cost reduction.

In order to achieve the above object, as a first aspect of the present invention, a wiring unit comprises: insulative substrates, each having through holes, to be stacked up each other; strip conductors, each having contact holes meeting the respective through holes, to be arranged in parallel on each of the insulative substrate; and a conductor pin consisting of a pin portion of conductive material to be inserted into both the through hole and the contact hole with a gap therewith and a conductor contact portion radially projecting from the pin portion so as to be put into contact with the strip conductor.

As a second aspect of the present invention, based on the first aspect, the conductor contact portion has a peripheral portion, being elestically deformable in a radial direction of the pin portion, to be put into contact with the strip conductor.

As a third aspect of the present invention, based on the first or second aspect, at least one of the strip conductors has a male tab to protrude from an end portion of one of the insulative substrates so as to be connected with a terminal electrically connected with external equipment.

As a fourth aspect of the present invention, an electric junction box comprises: insulative substrates, each having through holes, to be stacked up each other; strip conductors, each having contact holes meeting the respective through holes, to be arranged in parallel on each of the insulative substrate; a conductor pin consisting of a pin portion of conductive material to be inserted into both the through hole and the contact hole with a gap therewith and a conductor contact portion radially projecting from the pin portion so as to be put into contact with the strip conductor; and a male tab, provided on at least one of the strip conductors, to protrude from an end portion of one of the insulative substrates; and a connector unit consisting of a wire, a terminal connected with the wire, and a housing accommodating the terminal, the terminal being connected to the male tab.

According to the above-described structures of the present invention, the following advantages are provided.

(1) Because an electric connection, in accordance with a predetermined pattern, between the strip conductors can be attained by arbitrarily selecting the through hole, to which the conductor pin is inserted, of the insulative substrate and the contact hole of the strip conductor, manufacture man-hour can be reduced. And, because the molding pattern of the substrate is relatively simple, its cost can be reduced. And, because the contact hole is provided on the strip conductor itself, the deviation of the contact hole from the strip conductor does not occur and also the width of the insulative substrate can be reduced, thereby attaining the downsizing.

(2) Because the conductor pin is securely electrically connected with the strip conductor, the strip conductors can be securely electrically connected with each other even according to an arbitrarily predetermined pattern.

(3) Because the terminals electrically connected with external equipment can be connected to the male tabs of the strip conductors provided at the end portion of at least one of the insulative substrates, the external equipment and the strip conductors can be electrically connected with each other according to a desirable pattern.

(4) Because an electric connection, in accordance with a predetermined pattern, between the strip conductors can be attained by arbitrarily selecting the through hole, to which the conductor pin is inserted, of the insulative substrate and the contact hole of the strip conductor, and because the terminals of the connector unit electrically connected with external equipment can be connected to the male tabs of the strip conductors provided at the end portion of at least one of the insulative substrates, the fellow strip conductors or the external equipment and the strip conductors can be electrically connected with each other according to a desirable pattern, manufacture man-hour can be reduced. And, because the molding pattern of the substrate is relatively simple, its cost can be reduced. And, because the contact hole is provided on the strip conductor itself, the deviation of the contact hole from the strip conductor does not occur and also the width of the insulative substrate can be reduced, thereby attaining the downsizing. Further, because the terminals of the connector unit connected with the external equipment can be connected to the male tabs, the thickness of the electric junction box can be reduced, thereby downsizing the electric junction box.

The above and other objects and features of the present invention will become more apparent from the following description taken in conjunction with the accompanying drawings.

DESCRIPTION OF THE PREFERRED EMBODIMENT(S)

An embodiment of the present invention will now be described in further detail with reference to the accompanying drawings.

Figure 1:
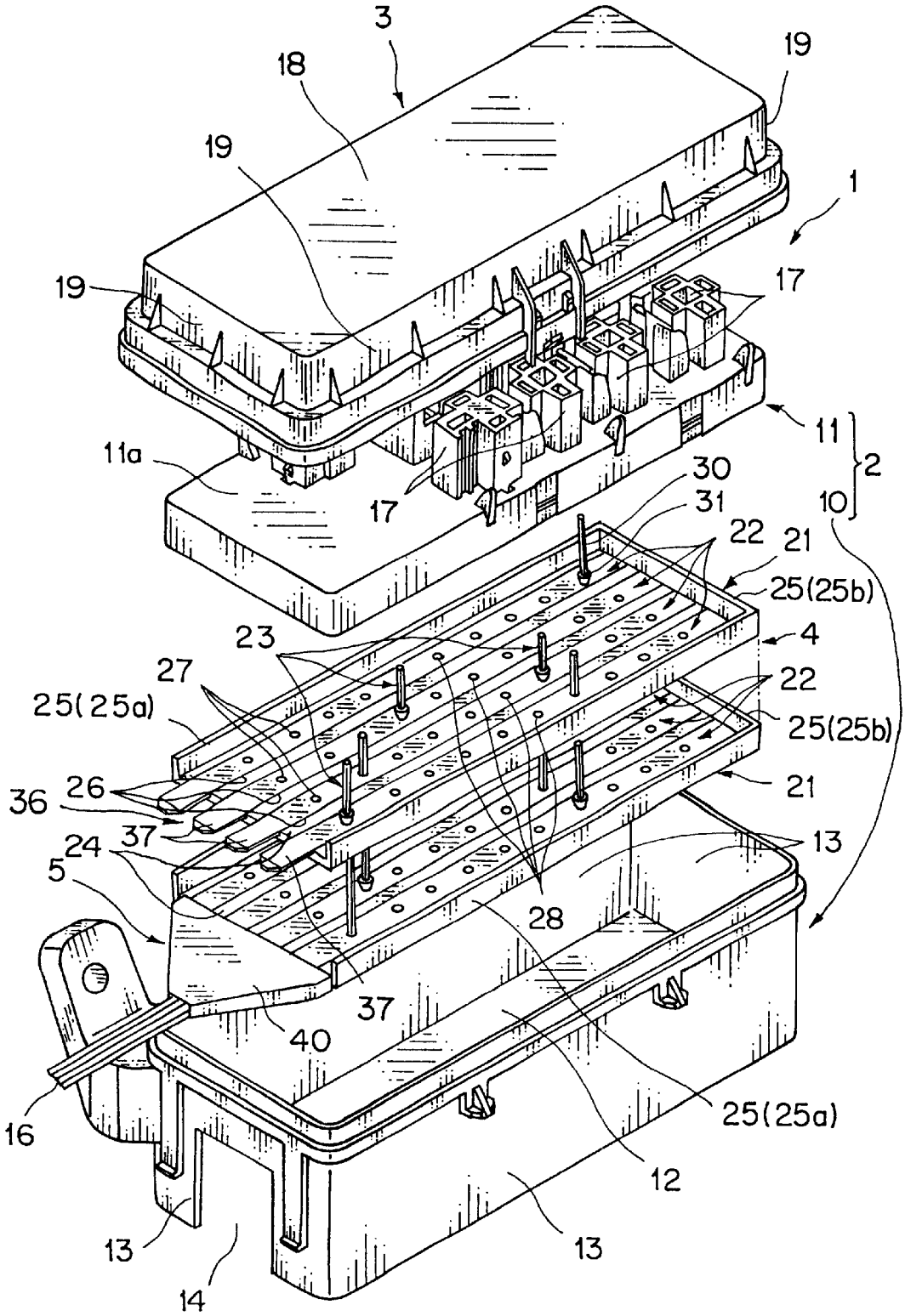
FIG. 1 is an exploded perspective view showing an embodiment of an electric junction box in accordance with the present invention.

A wiring unit and an electric junction box in accordance with the embodiment of the present invention are described by referring to FIGS. 1 to 5. The electric junction box 1 has a casing 2, a waterproof casing 3, a wiring unit 4 and a connector unit 5 as shown in FIG. 1.

The casing 2 has a back casing 10 and a front casing 11. The back casing 10 has a flat bottom wall 12 and peripheral walls 13 continuing from the periphery of the bottom wall 12 and is formed in a box-shape. The bottom wall 12 is formed rectangularly. The front peripheral wall 13 has an opening 14 for putting wires 16 connected to later-described terminals 15 of the above connector unit 5 (FIG. 5) therethrough.

The front casing 11 is formed tabularly. The front casing 11 is accommodated in the back casing 10 in a state of leaving a space against the bottom wall 12. The front casing 11 is provided with mounting portions 17 on its face 11*a* to mount relays, fuses, connectors and so on when accommodated in the back casing 10.

The waterproof casing 3 has a flat ceiling wall 18 and peripheral walls 19 continuing from the periphery of the ceiling wall 18 and is formed in a box-shape. The ceiling wall 18 is formed rectangularly. The waterproof casing 3 is attachable to and detachable from in an edge portion of the peripheral wall 13 of the back casing 10. When a peripheral wall 19 of the waterproof casing 3 is attached to the back casing 10, the above front casing 11 is covered therewith.

Figure 2:
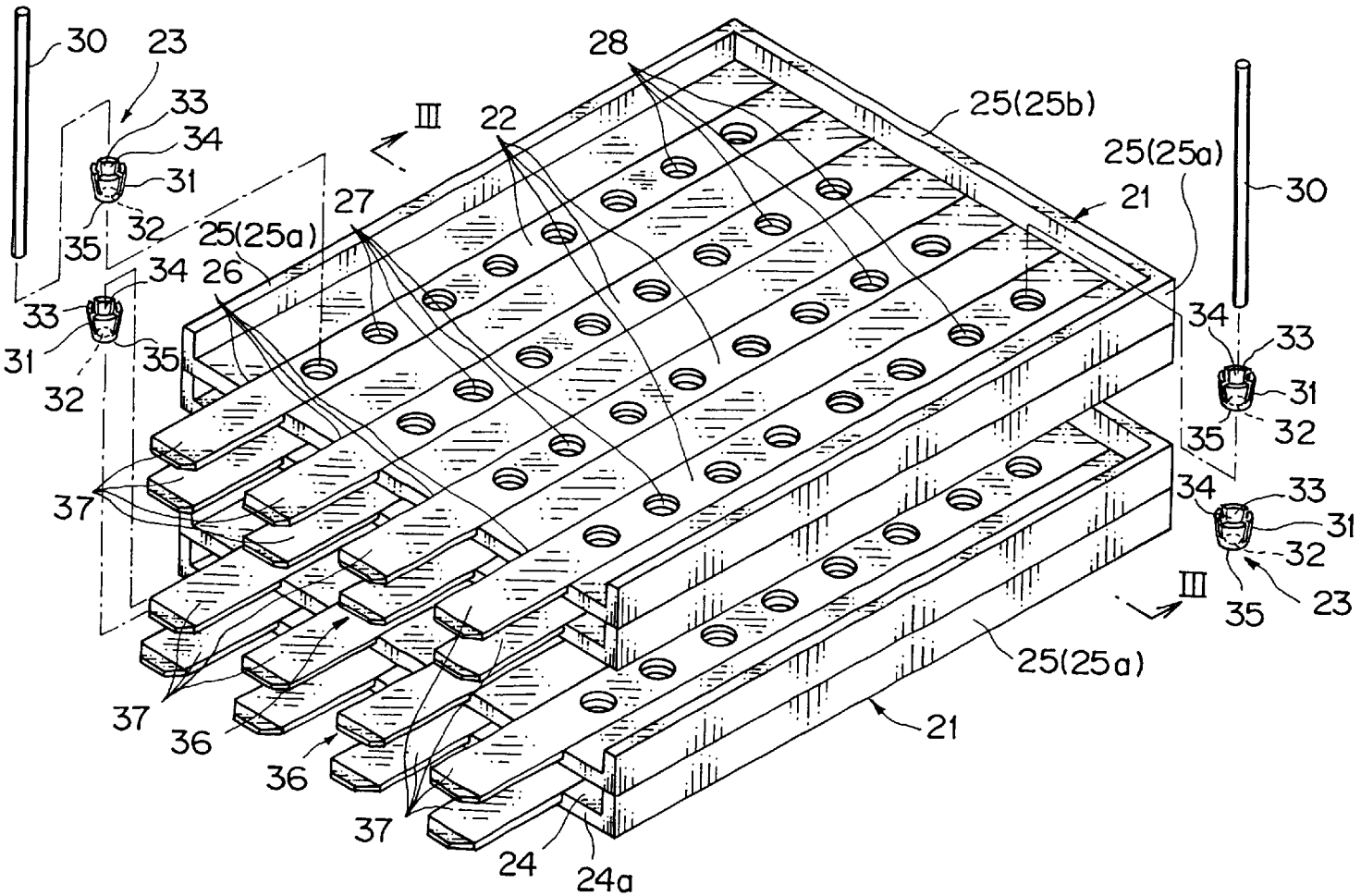
FIG. 2 is a perspective view showing a wiring unit of the same embodiment.
Figure 3:
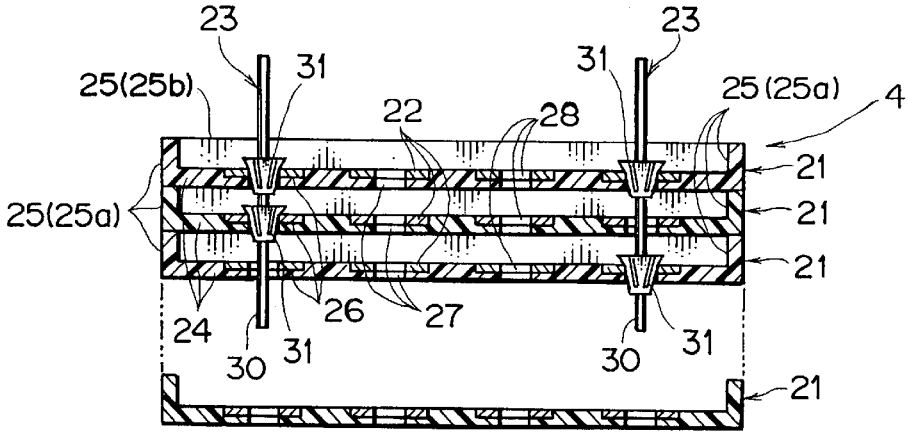
FIG. 3 is a sectional view taken along a line III—III in FIG. 2.

The wiring unit 4 is arranged between the front casing 11 and the bottom wall 12 of the back casing 10 and is accommodated in the back casing 10. The wiring unit 4, as shown in FIGS. 1 to 3, has a plurality of substrates 21 (insulative substrates) to be stacked up, busbars 22 (strip conductors), and pin units 23 (conductor pins).

The substrate 21 is made of insulative synthetic resin, for example, and has a flat wall 24 and a rim wall 25. The flat wall 24 is formed in a generally rectangular shape. A plurality of busbar positioning grooves 26 and through holes 27 is formed on the flat wall 24.

The busbar positioning grooves 26 are formed in a longitudinal direction of the flat wall 24 in parallel each other. In the illustrated example, four of the busbar positioning grooves 26 are formed.

The through holes 27 are provided on each busbar positioning groove 26 in a longitudinal direction of the flat wall 24. The through hole 27 is of a round hole. Each substrate 21 has the same arrangement of the through holes.

The rim wall 25 consists of a pair of first rim walls 25*a* extending in a longitudinal direction of the flat wall 24 and a second rim wall 25*b* connecting the first rim walls 25*a*. These rim walls 25*a*, 25*b* stand on the flat wall 24.

The busbar 22 is made of conductive metal and is formed in a strip. The busbars 22 are received in the respective busbar positioning grooves 26.

The busbar 22 has contact holes 28 relative to the respective through holes 27, which contact holes 28 are arranged in a longitudinal direction of the busbar 22. The contact hole 28 is of a round hole. The contact holes 28 meets the respective through holes 27 when the busbar 22 is placed in the busbar positioning groove 26.

Figure 4A:
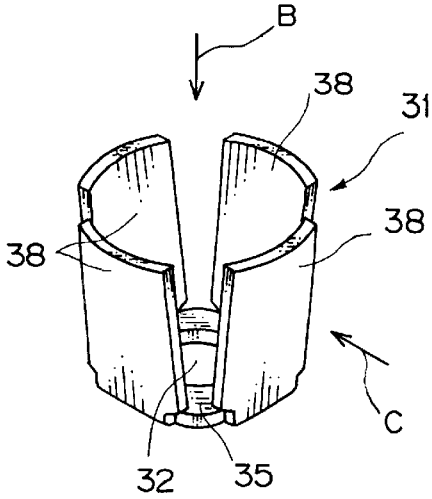
FIG. 4A is a perspective view showing a tab member of the same embodiment.

The pin unit 23 consists of a pin 30 as a pin portion and a tab member 31 as a conductor contact portion as shown in FIG. 1 and FIGS. 4A–AD. The pin 30 and the tab member 31 are made of conductive metal. The pin 30 is formed in a round bar having a smaller diameter than inside diameters of the holes 27, 28.

Figure 4B:
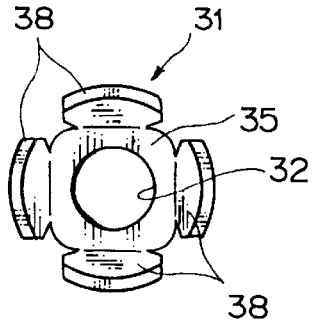
FIG. 4B is a view taken from an arrow B direction in FIG. 4A.
Figure 4C:
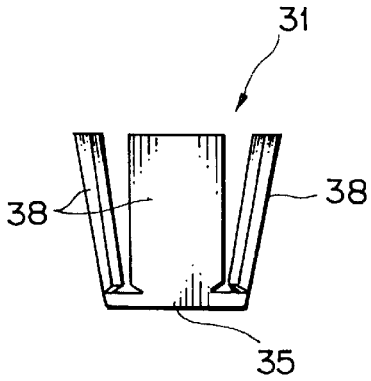
FIG. 4C is a view taken from an arrow C direction in FIG. 4A.
Figure 6:
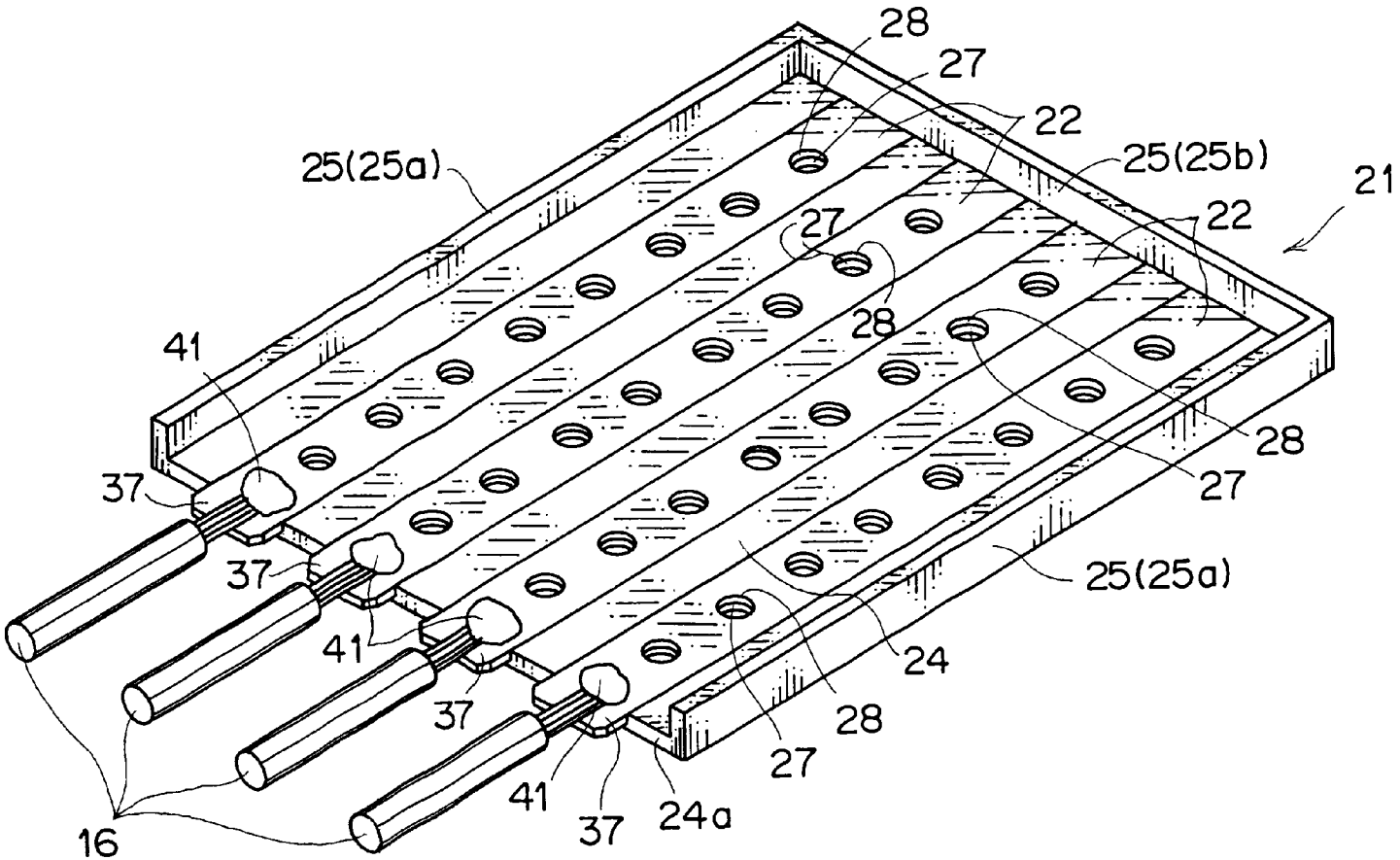
FIG. 6 is a perspective view showing a modified example of a connection state of a wire and a busbar.
Figure 7:
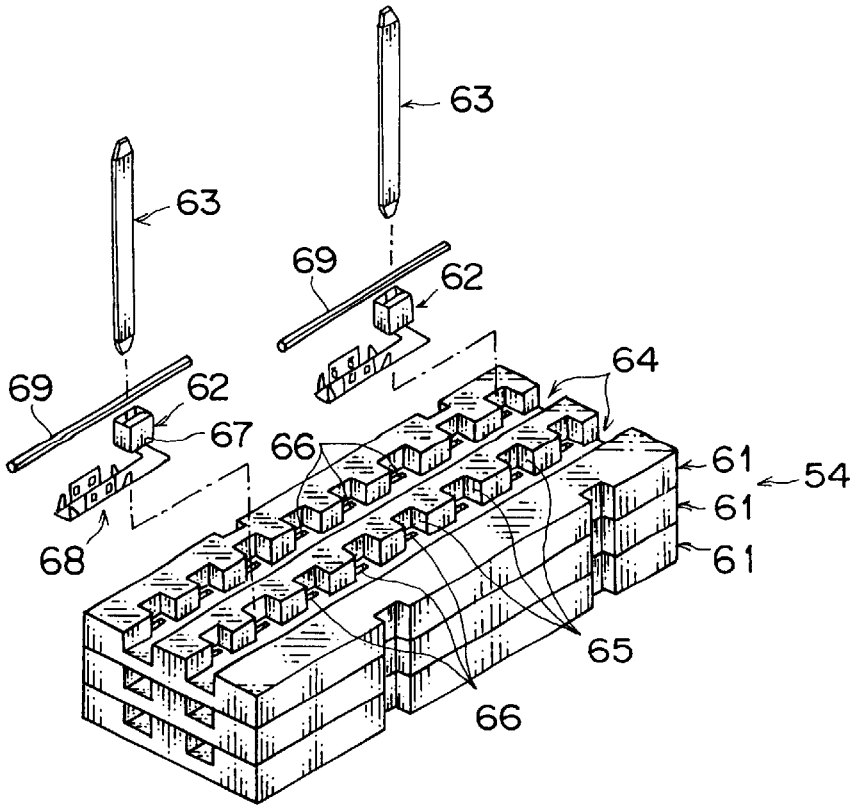
PRIOR ART FIG. 7
FIG. 7 is a perspective view showing a prior art wiring unit.
Figure 8:
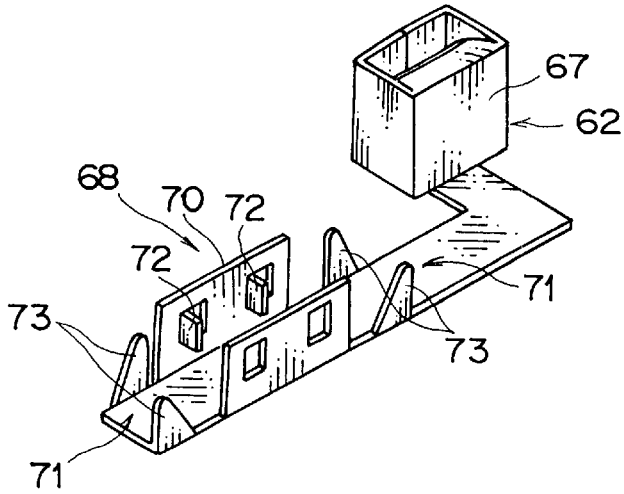
PRIOR ART FIG. 8
FIG. 8 is a perspective view showing a terminal of the wiring unit shown in FIG. 7.

The tab member 31 has a central portion 35 and peripheral portions 38 as shown in FIG. 2 and FIGS. 4A–AD. The central portion 35 is tabularly formed in a generally rectangular shape having circular-arc comers as shown in FIG. 4B. The central portion 35 has a pin hole 32 to fit on the pin 30 and is fixed to the pin 30. The central portion 35 may be soldered (portion 41 in FIG. 6) to the pin 30.

The peripheral portion 38 is tabular and continues from the central portion 35. The peripheral portions 38 are to be upstandingly arranged around the central portion 35 and are radially elestically deformable.

Figure 4D:
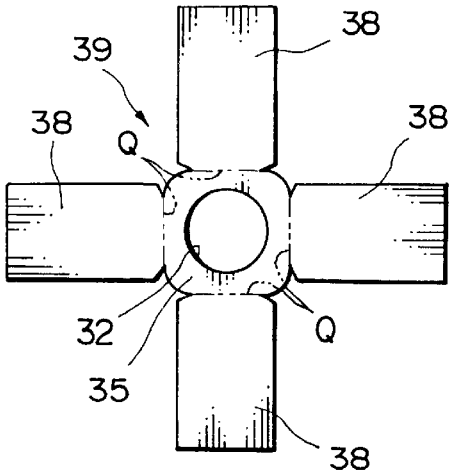
FIG. 4D is a plan view showing an intermediate of the tab member shown in FIG. 4A.

The tab member 31 is obtained from a intermediate 39 (FIG. 4D), wherein the central portion 35 and the peripheral portions 38 are in a plane, by bending the peripheral portions 38 along respective lines Q shown in FIG. 4D. The intermediate 39 is obtained by punching a metal plate. And, the tab member 31 is formed generally conically.

In the wiring unit 4, the substrates 21 on which the busbars 22 are arranged, are stacked up, and the pin units 23 are inserted into the respective predetermined contact holes 28 of the busbars 22 and simultaneously into the respective through holes 27. The tab member 31 of the pin unit 23 is put into contact with the inner wall surface of the contact hole 28 of the busbar 22.

The tab member 31 of the pin unit 23 is elastically deformed inwardly in its radial direction when inserted into the contact hole 28 of the busbar 22, whereby the peripheral portions 38 are put into tight contact the inner surface of the contact hole 28 and the tab member 31 is securely electrically connected with the busbar 22. That is, related busbars 22 can be securely electrically connected.

And, the pins 30 of the pin units 23 are electrically connected to respective arbitrarily predetermined mounting portions 17 through the respective through holes 27 and the respective contact holes 28, whereby the busbars 22 needed to be electrically connected are electrically connected each other and then are electrically connected to the respective predetermined mounting portions 17 each having a relay, fuse or the like. And, at least one of the substrates 21 is provided with a receiving portion 36 (FIG. 5).

The connector receiving portion 36 has a plurality of male tabs 37. The male tab 37 protrudes over one end plane 24a (an end portion) of the flat wall 24 as shown in FIG. 5. The male tab 37 is provided by four in the illustrated embodiment. The terminal 15 of the connector unit 5 is electrically connected to the male tab 37. Only the one connector unit 5 connected to the lowest connector receiving portion 36 is shown in FIG. 1, and the other are omitted.

Figure 5:
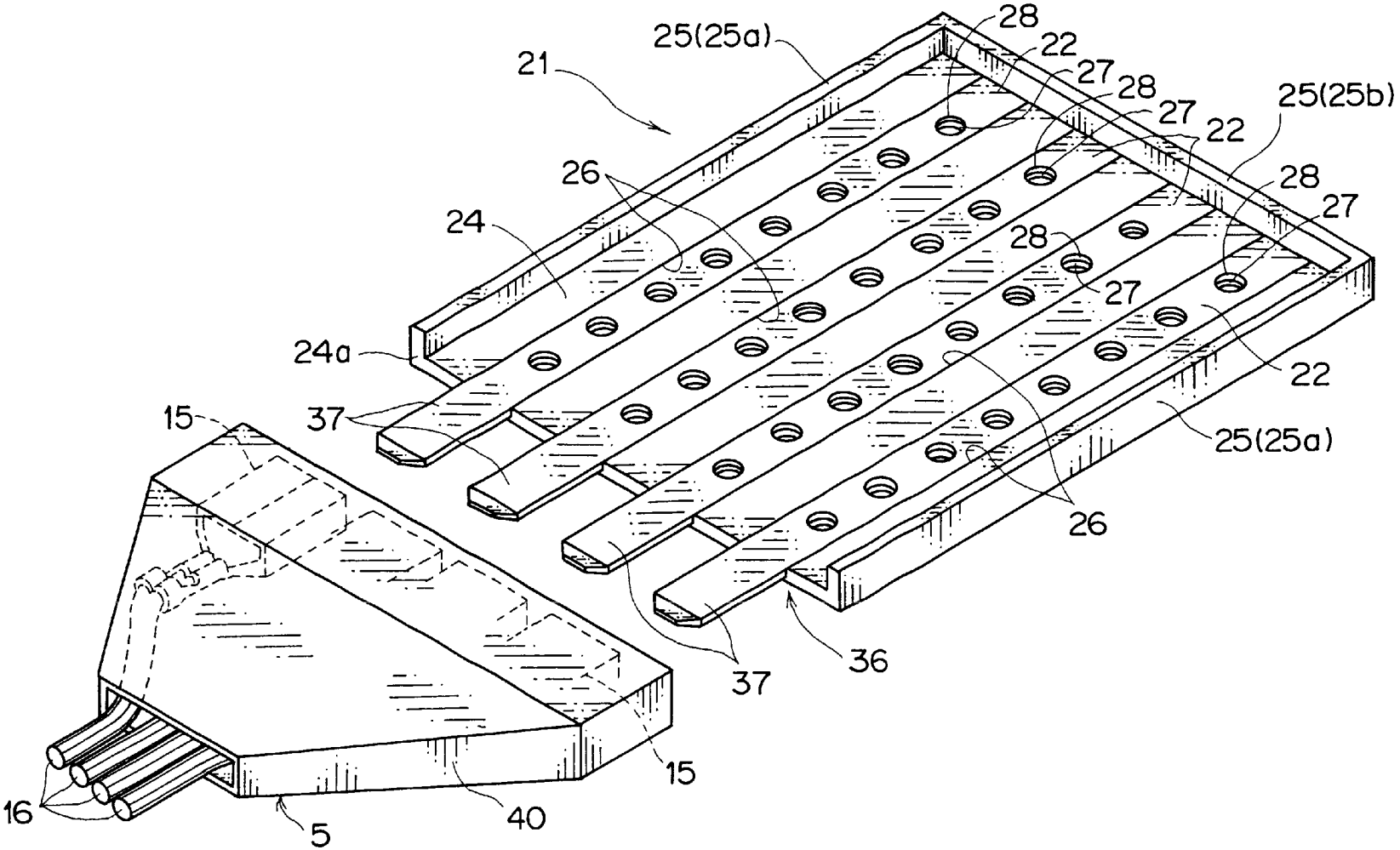
FIG. 5 is a perspective view showing a connector receiving portion of the same embodiment.

The connector unit 5 has a plurality of terminals 15 and a housing 40 as shown in FIG. 5. The housing 40 is made of insulative synthetic resin or the like. The terminals 15 connects with the respective male tabs 37 electrically.

The terminals 15 are accommodated in the housing 40. Wires 16 are connected to the respective terminals 15. These wire 16 are electrically connected to various external equipment such as the lamps, the motors, and the batteries.

The above connector unit 5 is connected to the connector receiving portion 36 by connecting the terminals 15 to the respective male tabs 37 and is accommodated in the back casing 10 along with the substrate 21. And, the wires 16 pass the opening 14.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A wiring unit, comprising:

insulative substrates, each having through holes, to be stacked up each other;

strip conductors, each having contact holes meeting the respective through holes, to be arranged in parallel on each of the insulative substrate; and a conductor pin consisting of a pin portion of conductive material to be inserted into both the through hole and the contact hole with a circular gap therewith and a conductor contact portion radially projecting from the pin portion and being bent in a longitudinal direction of the pin portion so as to be put into contact with the strip conductor.

2. The wiring unit as set forth in claim 1, wherein the conductor contact portion has a peripheral portion provided with a longitudinal slit, being elastically deformable in a radial direction of the pin portion, to be put into contact with the strip conductor.

3. The wiring unit as set forth in claim 1, wherein at least one of the strip conductors has a male tab to protrude from an end portion of one of the insulative substrates so as to be connected with a terminal electrically connected with external equipment.

4. The wiring unit as set forth in claim 2, wherein at least one of the strip conductors has a male tab to protrude from an end portion of one of the insulative substrates so as to be connected with a terminal electrically connected with external equipment.

5. An electric junction box, comprising:

insulative substrates, each having through holes, to be stacked up each other;

strip conductors, each having contact holes meeting the respective through holes, to be arranged in parallel on each of the insulative substrate;

a conductor pin consisting of a pin portion of conductive material to be inserted into both the through hole and the contact hole with a circular gap therewith and a conductor contact portion radially projecting from the pin portion and being bent in a longitudinal direction of the pin portion so as to be put into contact with the strip conductor; and a male tab, provided on at least one of the strip conductors, to protrude from an end portion of one of the insulative substrates; and a connector unit consisting of a wire, a terminal connected with the wire, and a housing accommodating the terminal, the terminal being connected to the male tab.

* * * * *